US008181560B2

(12) United States Patent
Hauser et al.

(10) Patent No.: US 8,181,560 B2
(45) Date of Patent: May 22, 2012

(54) FOOD PROCESSING TOOL

(75) Inventors: Lawrence M. Hauser, Auburn, WA (US); Ricky Wai Kit Chan, Bellevue, WA (US); Joanna Clark, Tacoma, WA (US)

(73) Assignee: Progressive International Corporation, Kent, WA (US)

( * ) Notice: Subject to any disclaimer, the term of this patent is extended or adjusted under 35 U.S.C. 154(b) by 436 days.

(21) Appl. No.: 12/606,929

(22) Filed: Oct. 27, 2009

(65) Prior Publication Data

US 2011/0094111 A1 Apr. 28, 2011

(51) Int. Cl.
*B26D 1/03* (2006.01)

(52) U.S. Cl. ..... 83/858; 83/932; 83/856; 83/109; 83/437.2; 30/287; 30/340; 30/283; 99/537

(58) Field of Classification Search ..... 83/858, 83/856, 932, 698.11, 440.2, 104, 105, 109, 83/418, 420, 703, 425.2, 425.3, 431, 437.1, 83/437.2, 717, 435.11, 955, 720, 78, 167, 83/240, 248, 255, 268, 276, 277, 279, 705, 83/707, 719, 729, 730, 425, 438, 448, 449; 30/286, 340, 165, 321, 114, 278, 279.2, 283; 99/537

See application file for complete search history.

(56) References Cited

U.S. PATENT DOCUMENTS

| | | | | |
|---|---|---|---|---|
| 4,095,339 | A | 6/1978 | Turner | |
| 4,212,431 | A | 7/1980 | Doyel | |
| 4,573,384 | A | 3/1986 | Jones | |
| 4,805,843 | A | 2/1989 | Draper | |
| 4,848,680 | A * | 7/1989 | Borner | 241/95 |
| D331,687 | S | 12/1992 | Pujol Gilbert | |
| 5,245,902 | A | 9/1993 | Pereira | |
| 5,431,078 | A | 7/1995 | Ricard et al. | |
| 5,692,424 | A | 12/1997 | Wallace | |
| 6,209,439 | B1 | 4/2001 | Repac et al. | |
| D447,391 | S | 9/2001 | Bodum | |
| 6,732,622 | B2 * | 5/2004 | Vincent | 83/247 |
| 6,805,032 | B2 | 10/2004 | Engdahl | |

(Continued)

FOREIGN PATENT DOCUMENTS

EP 1798010 6/2007

(Continued)

OTHER PUBLICATIONS

"Easy Slice 2, Folding Mandoline," Zyliss Swiss International, pp. 8, printed May 18, 2009.

*Primary Examiner* — Phong Nguyen
(74) *Attorney, Agent, or Firm* — Lowe Graham Jones PLLC

(57) ABSTRACT

A food processing tool particularly suited for processing garlic and the like generally includes a main body having a tray configured to allow garlic to be passed back and forth across the tray for processing as desired. The main body optionally includes a pair of opposing guides positioned on opposing lateral sides of the tray and a plurality of ribs provided along either a portion or the entirety of the tray to reduce friction and improve the sliding ability of the garlic along the ribs and therefore the tray. A main slicing blade and one or more pluralities of blades are provided to slice, mince, or julienne cut the garlic. A pusher and cap is configured to selectively allow or restrict rotational movement of the cap and garlic for different orientations when cutting.

14 Claims, 3 Drawing Sheets

U.S. PATENT DOCUMENTS

| | | | | |
|---|---|---|---|---|
| D499,615 | S | 12/2004 | Nordgren | |
| D519,001 | S | 4/2006 | So | |
| 7,066,071 | B2 * | 6/2006 | Zeder et al. | 83/698.11 |
| D546,638 | S | 7/2007 | Kaposi | |
| 7,444,909 | B2 | 11/2008 | Repac et al. | |
| 7,621,207 | B2 | 11/2009 | Botsai et al. | |
| 2004/0055437 | A1 | 3/2004 | Engdahl | |
| 2009/0255391 | A1 * | 10/2009 | Hood et al. | 83/648 |

FOREIGN PATENT DOCUMENTS

| | | |
|---|---|---|
| GB | 2313771 | 12/1997 |
| WO | 02064331 | 8/2002 |

* cited by examiner

FOOD PROCESSING TOOL

FIELD OF THE INVENTION

This invention relates generally to a device capable of processing garlic and similar food items, including a device that can slice, mince, and cut julienne strips.

BACKGROUND OF THE INVENTION

There are a variety of tools available for processing garlic and similar food items. For the most part, garlic is typically crushed or pounded, sliced with a knife, or minced by forcing it through a garlic mincer. Each of these methods has its own advantages and drawbacks, and none readily provide an ability to slice, mince, or julienne easily with a single device.

SUMMARY OF THE INVENTION

A food processing or garlic tool in accordance with the invention generally includes a main body having a tray configured to allow garlic to be passed back and forth across the tray for processing as desired. The main body optionally contains several additional features, including a pair of opposing guides positioned on opposing lateral sides of the tray and a plurality of ribs provided along either a portion or the entirety of the tray to reduce friction and improve the sliding ability of the garlic along the ribs and therefore the tray.

A main blade is positioned centrally in the region of the main body in order to slice garlic as it passes back and forth laterally over the main blade. A pusher is also provided in order to move the garlic more safely across the blades. Preferably, the pusher is engaged with the guides for smooth sliding movement.

A plurality of blades may optionally extend upward from the main body tray in order to score or slice the garlic as it passes over the blades prior to being sliced by the main blade. The pusher also allows for optional rotational movement in order to score the garlic along multiple paths so that it can be minced rather than cut into strips. A catch tray below the main blade may also be provided in order to collect the cuttings.

It should be noted that while the garlic tool is particularly well-suited for processing garlic, it also works well for other small food items. Thus, the use of the term "garlic tool" and the description related to the processing of garlic is for ease of reference and should not be taken to limit the tool's use to garlic alone.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
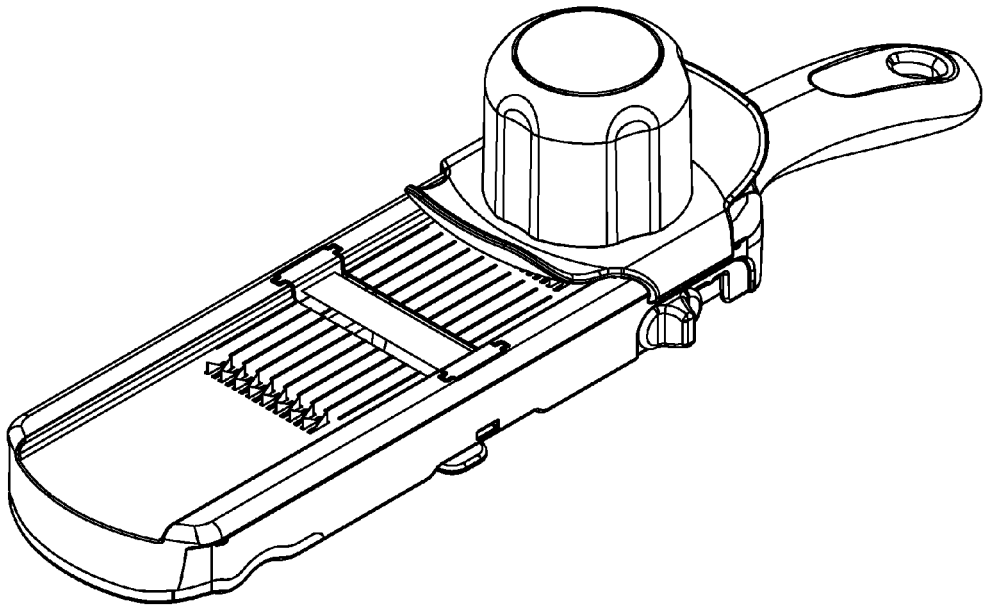
FIG. 1 is a top perspective view of a preferred garlic tool.
Figure 2:
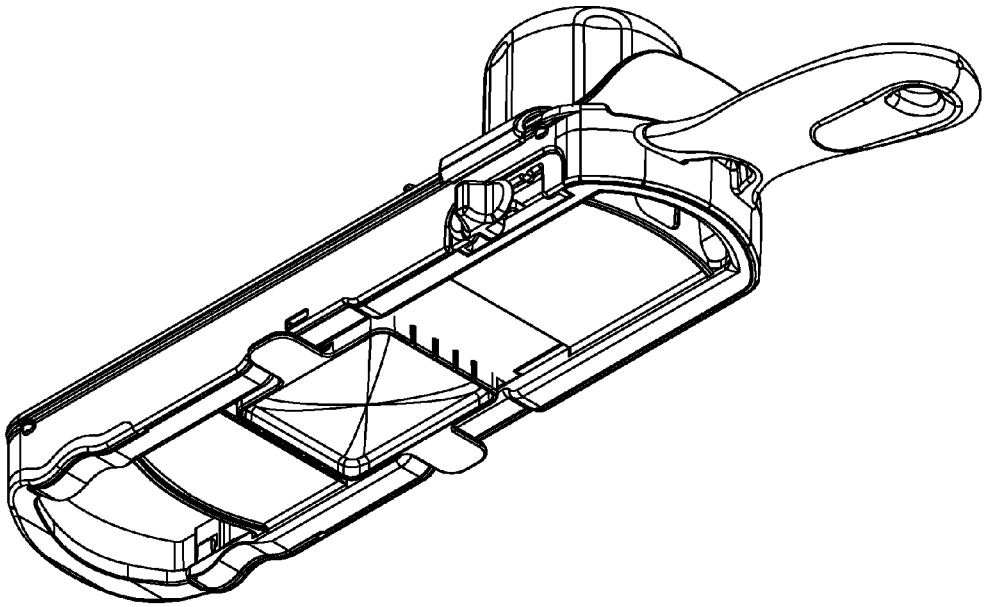
FIG. 2 is a bottom perspective view of a preferred garlic tool.
Figure 3:
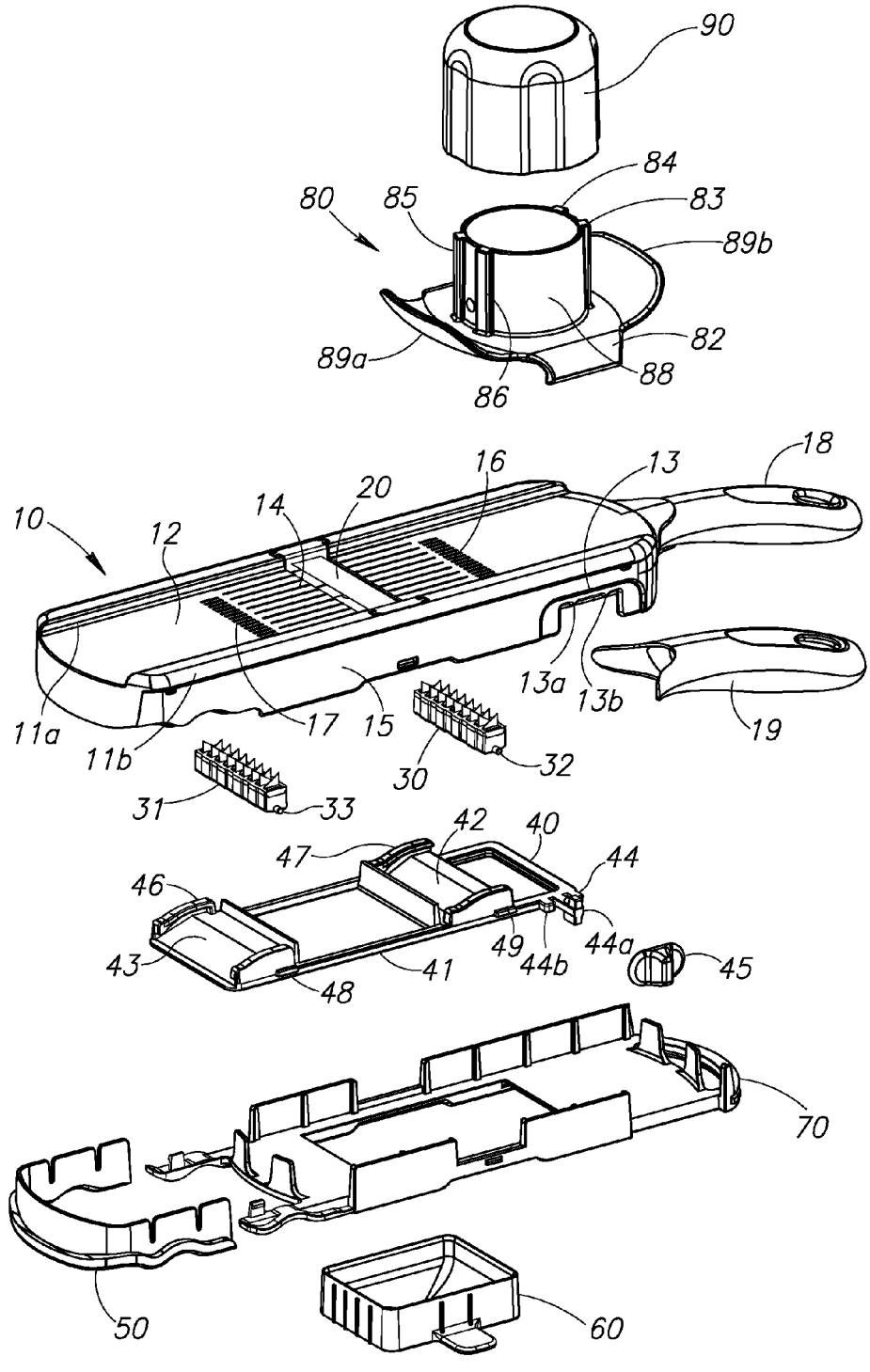
FIG. 3 is an exploded view of the preferred garlic tool of FIGS. 1 and 2.
Figure 4:
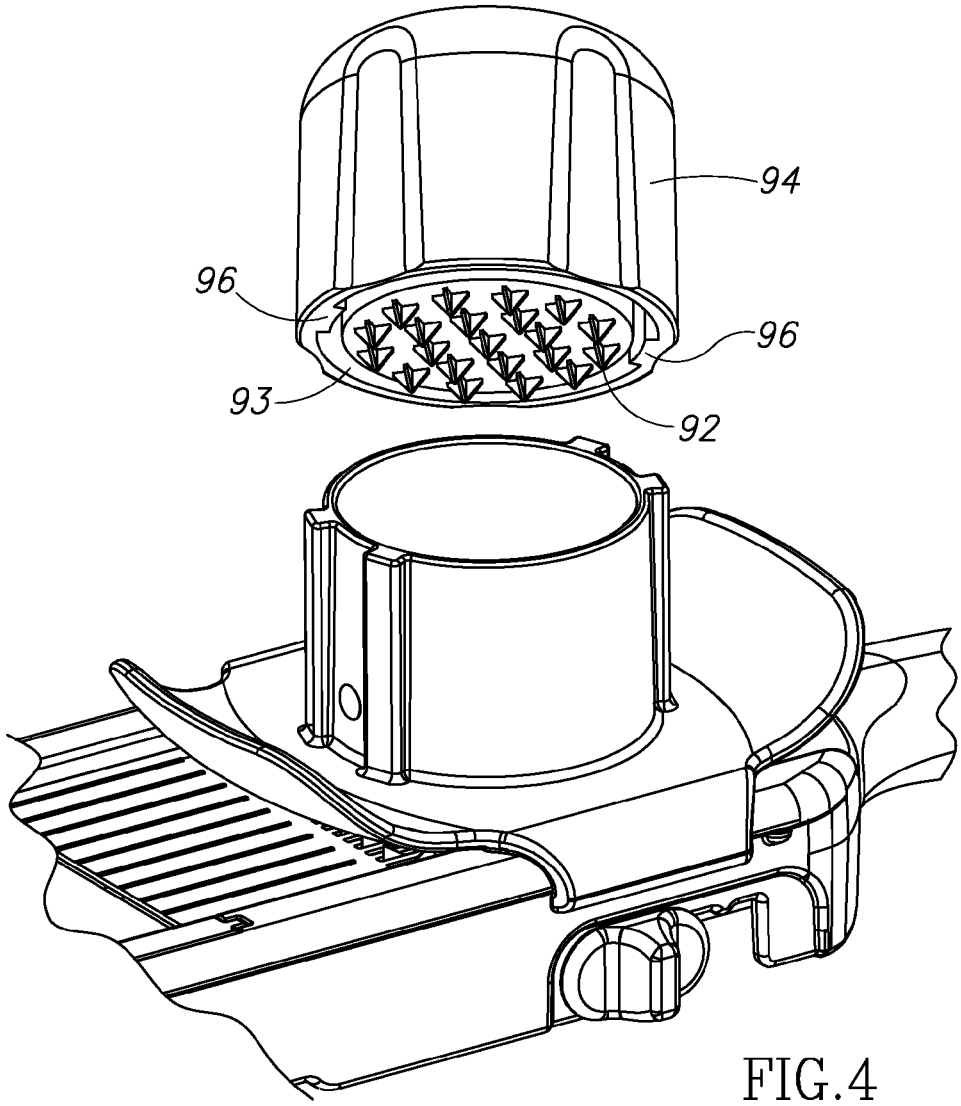
FIG. 4 is a perspective view of the pusher and pusher housing of a preferred garlic tool.
Figure 5:
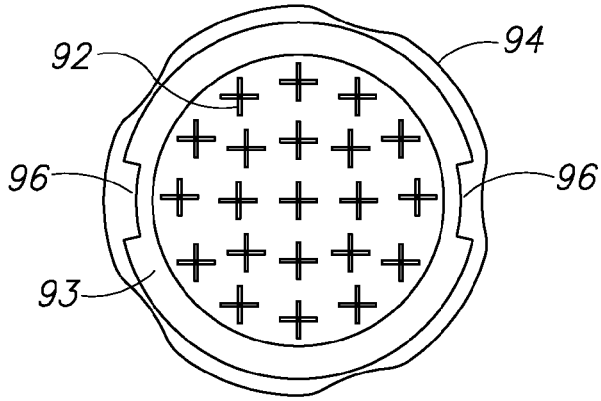
FIG. 5 is a bottom view of a preferred pusher cap.

The preferred garlic tool includes a main body 10 having a tray 12 configured to allow garlic to be passed back and forth across the tray for processing as desired. The main body of the version as shown contains several additional features, including a pair of opposing guides 11*a*, 11*b* positioned on opposing lateral sides of the tray 12 and a plurality of ribs 14 provided along either a portion or the entirety of the tray to reduce friction and improve the sliding ability of the garlic along the ribs and therefore the tray. It should be noted that while the garlic tool is particularly well-suited for processing garlic, it also works well for other small food items. Thus, the use of the term "garlic tool" and the description related to the processing of garlic is for ease of reference and should not be taken to limit the tool's use to garlic alone.

One end of the main body terminates in a handle 18 which may include an opening for receiving a hook. The main body is preferably formed from a rigid plastic material, but may be formed from metal, ceramic, or other such materials. In some versions, portions of the main body include resilient materials to improve the grip and reduce slipping. Thus, in the illustrated version the handle includes a resilient section 19 formed from TPE, neoprene, rubber, or other such materials having a higher coefficient of friction than the plastic or other material used for the main body. In addition, a non-slip base 50 is provided at the end of the main body opposite the handle. The non-slip base is provided on the lower side of the main body, opposite that of the tray 12 which forms the upper side of the main body.

The main body further includes a blade 20 and at least one set of julienne blades 30. As shown, a first set of julienne blades 30 and a second set of julienne blades 31 are positioned on opposite sides of the main slicing blade 20, such that the first set of julienne blades 30 is between the main blade 20 and the handle 18 and the second set of julienne blades 31 is between the main blade 20 and the distal end of the tray.

In order to accommodate the sets of julienne blades 30, 31, the main body includes a first plurality of blade slots 16 and a second plurality of blade slots 17. The first plurality of blade slots are located relatively adjacent the handle. In the illustrated example, the tray is generally longitudinal, forming a tray axis extending from the handle to the distal end of the tray. The first plurality of blade slots 16 if formed from several small slots, each of which individually extends along a line that is substantially parallel to the tray axis. The plurality of blade slots are aligned as a collection such that each individual slot is spaced apart from each other slot along a line that is substantially orthogonal to the tray axis. The second plurality of blade slots 17 is similarly formed from several small slots, each of which is substantially parallel to the tray axis and the collection of which is arrayed to be generally perpendicular to the tray axis. As described more fully below, the pluralities of blades are positioned below the slots so that they can selectively extend through the slots and above the tray surface or retract below the tray surface. When extending above the tray surface, each of the individual julienne blades is preferably configured so that they are generally perpendicular to a plane defined by the surface of the tray.

A main slicing blade 20 is secured within the main body and located such that it substantially spans the surface of the tray from one lateral side to the other. The main slicing blade is positionable so that its slicing edge is above the upper surface of the tray, defining a distance between the main slicing blade 20 and upper surface of the tray 12. When garlic or other food items are passed along the surface of the tray and into the blade 20, the food item is sliced with the thickness of the slice being determined by the distance between the slicing blade and the surface of the tray. In the preferred version as shown, the slicing blade 20 includes a sharpened edge at both sides of the blade, including a first side facing the handle and a second side facing the distal end of the tray.

In one version of the tool, the main slicing blade 20 is positioned at a fixed location with respect to the surface of the tray. In such a version, the fixed distance is preferably small, and most preferably approximately ⅛ inch. Most preferably, the blade is formed from metal and includes an integral vertical arm terminating in a flange that is permanently affixed to the guides 11*a*, 11*b*. In other versions different fixed distances may be used. Likewise, in some versions the height of the slicing blade may be adjustable by providing a knob or other mechanism to allow the blade to be raised and lowered.

The main body includes peripheral sidewalls 15 substantially surrounding much of the perimeter of the main body and extending below the upper surface of the tray. The sidewalls may be integrally formed with the tray and provide structural support and rigidity for the tray, as well as surfaces for attaching adjustment mechanisms, bottom caps, and a tray as further discussed below.

A blade deployment mechanism 40 is secured to the main body 10 to provide a means for extending and retracting the julienne blades 30, 31. In the preferred version as shown, the blade deployment mechanism is a single integrally formed rack to facilitate extension and deployment of both sets of julienne blades simultaneously. In other versions, however, there is only one set of julienne blades or two separate blade deployment mechanisms may be used. Likewise, rather than the ramp and slide configuration in the preferred example, the blade deployment mechanism may include a tab and slot allowing for vertical sliding of the tab to deploy the blades, a rotational knob, or yet other structures.

The exemplary mechanism includes a rack 41 having first ramp 42 and a second ramp 43, each of the first and second ramps being positioned beneath a respective one of the pluralities of blades 30, 31 and corresponding pluralities of slots 16, 17. The ramps are configured such that sliding or lateral movement of the rack in a first direction causes a lower surface of the pluralities of blades to be urged upward by the ramp while lateral movement of the rack in the opposite direction allows the blades to fall downward as they engage a lower portion of the ramp. The blades may be spring loaded, for example by including a spring between the blade cartridge and the tray to urge the blades downward, away from the tray.

Each of the first and second pluralities of blades is arrayed together and secured within a cartridge to maintain the blades firmly in a desired parallel orientation and to allow them to be raised and lowered together. The cartridges include a pair of peripheral pins extending laterally outward from the cartridges and generally parallel to the blade axis which is perpendicular to the tray axis. In the exploded view, pins 32, 33 on one side of each of the cartridges are visible, with the pins on the opposite sides in a similar position but hidden from view.

The pins are configured to be received within corresponding slots formed in retaining walls extending along and slightly above the ramps 42, 43. In the exploded view, slots 46, 47 are visible on one side of each ramp, with the opposing slots in a mirror-image position hidden from view. Each of the slots follows a path that is substantially the same as the path defined by the ramps. Accordingly, movement of the rack with respect to the cartridges causes the pins to move along the path defined by the slots, thereby causing the cartridges to move up and down as the slots go up and down. With the inclusion of the pin- and slot arrangement, the cartridges are urged downward by the lateral movement of the rack, thereby making the inclusion of a spring unnecessary.

The cartridges are further retained by interior surfaces formed within the main body 10. Flanges extending downward from the lower surface of the tray (or, alternatively, extending inward along the lateral surfaces of the sidewalls) retain the cartridges in a fixed position along the tray axis, thereby ensuring that the blades are always aligned with respect to the corresponding slots. Likewise, sliding movement of the track (and therefore the ramps and corresponding slots) causes the cartridges to move only in a vertical direction while staying in a fixed lateral position.

The rack 41 further includes a plurality of lateral tabs 48, 49 that engage corresponding grooves located on interior surfaces of the sidewalls. The tab and groove arrangement allows the rack to travel along a fixed path as defined by the length of the grooves.

The rack also includes a finger 44 projecting laterally from one side of the rack. The sidewall 15 of the main body 10 is formed with a corresponding cutout 13 that is sized and configured to allow the finger to extend through the cutout. A knob 45 is attached to the end of the finger, with the knob including a peripheral flange to substantially cover the cutout. Thus, movement of the knob and finger laterally within the cutout causes lateral sliding movement of the rack and corresponding upward or downward movement of the blades.

The cutout 13 may be formed with one or more projections 13*a*, 13*b* that are configured to encounter a mating surface on the finger to serve as stops. Most preferably, the finger 44 includes a pair of indentations 44*a*, 44*b*, with one indentation provided on each side of the finger. The indentations are sized to receive the projections 13*a*, 13*b* so that additional force is required to cause the finger and rack to move laterally to disengage the projections from the indentations. Consequently, the projections provide stops to hold the rack substantially in position. By locating the projections appropriately along the opening, they form stops to allow the rack hold the pluralities of julienne blades securely in position either retracted below or extending fully above the tray.

The blades within the cartridges are each formed to include a cutting edge that is angled, rather than vertical, with respect to the plane defined by the tray. In the preferred version, both edges of the blade are angled such that the portion of the blade extending above the tray is substantially triangular in shape. In addition, both edges are sharp, allowing the blades to cut a food item as it moves in the axial direction across the tray in either direction.

A bottom cap 70 is secured to the lower surface of the main body. The bottom cap securely retains the rack 40 between the bottom cap and the main body, and includes a lower rail that serves to guide longitudinal movement of the rack between the bottom cap and the main body.

A catch tray or bowl 60 is removably located beneath the main slicing blade 20. A corresponding opening in the tray and beneath the main blade allows cut and processed food to pass through the opening where it is collected by the tray. In one example, the tray is formed such that it is somewhat larger than a tray opening formed by internal sidewalls in the rack or in the bottom cap, thereby frictionally holding the catch tray to the lower side of the tool. As shown, the catch tray includes one or more laterally extending flanges or handles to allow the user to grasp the tray and separate it from the main body.

A pusher guide 80 is configured to allow garlic or food items to be moved laterally along the tray in the direction of the tray axis. The pusher guide includes a pair of opposing grips that grasp the guides 11*a*, 11*b* to hold the pusher guide adjacent the upper surface of the tray. In the preferred version, the grips are formed as curved lateral extensions of the pusher guide, with the extensions curving outward and downward and terminating in a horizontal inward-turned flange to engage the lateral and at least a portion of a lower surface of the guides 11*a*, 11*b*. The grips therefore restrict vertical movement of the pusher guide with respect to the tray. The pusher guide may be removed from the guides by sliding it fully beyond either the distal end of the tray or the proximal end of the tray adjacent the handle. Alternatively, the ends of the guides 11*a*, 11*b* may include projections that substantially prevent the pusher guide from sliding beyond the end of the guides 11*a*, 11*b*.

The pusher guide in the exemplary version further includes a pair of guards 89*a*, 89*b*. The guards are oriented between the pair of grips, such that the guards will be generally axially aligned with the tray axis when the pusher guide is attached to the main body. The guards are preferably in the form of lateral flanges extending radially outward and upward from the pusher guide. Accordingly, the guards will help to protect the hands of a user from being cut by any of the blades that form part of the tool.

The pusher guide is preferably formed with an upwardly extending cylinder that is generally hollow at its interior, with the hollow interior being configured to receive the pusher as described below. An exterior surface of the cylinder along the pusher guide includes several vertical posts, and in the version as shown four posts 83, 84, 85, 86 are provided. The posts form channels or grooves for receiving corresponding posts or stops formed in the pusher 90.

The pusher 90 generally serves as a cap to surround the pusher guide 80. The pusher includes an internal cylinder 92 that is sized and shaped to be received within the cylinder formed within the pusher guide. The complementary shapes of the internal pusher cylinder 92 and the hollow interior cylinder of the pusher guide allows the pusher cylinder to rotate within the pusher guide cylinder.

A lower surface of the pusher cylinder contains a plurality of spikes for engaging the surface of a clove of garlic or other food item to be sliced or minced. A spiked surface is preferred because the spikes can push into the clove to hold it firmly as it is moved back and forth through the blades. In the exemplary version, the spikes are formed as pyramids having four triangular planes that are perpendicular to one another and radiate outward from a central axis. Other forms of spikes or frictional surfaces for the lower surface of the pusher cylinder may also be used in alternative versions of the invention.

The pusher further includes a generally cylindrical interior channel 93 formed by the sidewalls of the internal pusher cylinder 92 and sidewalls the outer pusher cap 94. The pusher guide cylinder is received within the channel to retain the pusher within the pusher guide and to allow for rotational movement of the pusher within the pusher guide.

Within the interior channel 93, one or more stops 96 are provided. In the version as shown, the stops are in the form of tabs, shoulders, or posts formed on the inner sidewall of the pusher cap. Accordingly, the stops are sized and positioned to allow for rotational movement of the pusher within the pusher guide except to the extent that the stops 96 engage the posts 83-86. Most preferably, the posts are arranged in two sets of pairs of posts 83, 84 and 85, 86 placed on opposite sides of the pusher guide cylinder. Each of the posts in the pairs of posts is spaced apart just far enough to allow a stop 96 to fit between them. The exemplary pusher likewise includes a pair of stops, each one diametrically opposed to the other on opposite sides of the cap. When the pusher cap is placed within the pusher guide such that the stop is between the two posts forming a pair, the pusher cap is substantially restricted from any rotational movement. In a preferred version, an upper surface of the cap includes directional indicators that provide a visual aid in aligning the cap in the proper orientation so that the stop is between a pair of posts.

Alternatively, when the pusher cap is placed within the pusher guide such that the stop is not between two adjacent posts forming a pair, but instead is placed between posts assigned to different pairs, the pusher cap is allowed to rotate along a path defined by the length of the arc between posts associated with different pairs of posts. In the preferred example, by providing two pairs of posts and two stops on the cap, the arrangement of the stops and posts can be configured to allow the pusher to rotate through approximately 90 degrees of rotational movement.

In operation, a food item such as a clove of garlic is placed within the pusher guide cylinder and then the pusher is placed over the pusher guide. If the preference is to slice and produce julienne strips of the garlic, then the pusher is mounted as described above to restrict rotational movement. In addition, the knob 45 is placed in position such that the pluralities of julienne blades are extending above the tray. Then the pusher guide is moved across the blades where the clove is cut by the blades, with the cuttings being collected in the catch tray 60.

If the user prefers to simply slice the clove without also cutting it into julienne strips, the knob 45 is adjusted to retract the plurality of blades below the surface of the tray. Accordingly, movement of the pusher across the tray causes the clove to be cut by the main blade 20 but not by the plurality of julienne blades.

The user may also want to mince the garlic or other food item. In such a case, the pusher is attached to the pusher guide as described above to allow for rotational movement. When in this configuration, a clove or other item placed between the pusher and the tray can be moved across the plurality of blades in a first pass in which it is cut by the plurality of blades. The pusher is then rotated 90 degrees, thereby rotating the clove as well, and moved across the plurality of blades in a second pass to cut the clove again in a series of cuts that is perpendicular to the first series of cuts. When the clove is then moved across the main blade 20, the clove is sliced into small cubes, producing a minced cut of the clove.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A food processing tool, comprising:

a main body including a tray having a surface substantially forming a plane, the main body having a proximal end and a distal end with a first lateral side and an opposing second lateral side extending between the proximal end and the distal end;

a handle extending from the proximal end of the main body;

a main slicing blade having a sharpened edge extending above the plane of the tray and further extending substantially between the first lateral side and the second lateral side;

a first plurality of blades extending above the surface of the tray, the first plurality of blades being non-parallel with the plane defining the surface of the tray, the first plurality of blades configured to be selectively movable between a first position in which the first plurality of blades are extending above the surface of the tray and a second position in which the first plurality of blades are retracting below the surface of the tray;

a second plurality of blades, the second plurality of blades being configured to be selectively movable between a first position in which the second plurality of blades are extending above the surface of the tray and a second position in which the second plurality of blades are retracting below the surface of the tray;

wherein the first plurality of blades is positioned between the main blade and the distal end of the main body and the second plurality of blades is positioned between the main blade and the proximal end of the main body; and wherein the first plurality of blades is housed in a first cartridge and the second plurality of blades is housed in a second cartridge, each of the first cartridge and the second cartridge being carried by a rack mounted to the main body for lateral movement generally along an axis extending from the proximal end to the distal end, and a first surface formed on the rack such that lateral movement of the rack in a first direction causes the first cartridge to engage the first surface, thereby urging the first cartridge upward and extending the first plurality of blades into the first position, and a second surface formed on the rack such that lateral movement of the rack in the first direction causes the second cartridge to engage the second surface, thereby urging the second cartridge upward and extending the second plurality of blades into the first position.

2. The food processing device of claim 1, wherein the first plurality of blades is positioned between the main blade and the proximal end of the main body.

3. The food processing device of claim 1, wherein the first plurality of blades is positioned between the main blade and the distal end of the main body.

4. The food processing device of claim 1, further comprising an opening formed in the tray adjacent the main blade and a bowl removably mounted to the main body beneath the opening, the bowl being configured to collect sliced food items passing across the main blade and through the opening.

5. The food processing device of claim 1, further comprising a pusher configured for engaging a food item to be cut by the food processing device.

6. The food processing device of claim 5, further comprising a pusher guide, the pusher guide having a first grip for engaging the first lateral side of the main body and a second grip for engaging the second lateral side of the main body, the first and second grips securing the pusher guide to the tray to allow movement of the pusher guide along a path between the proximal end and the distal end of the main body.

7. The food processing device of claim 6, further comprising at least one stop formed on the main body such that the pusher guide is engageable with the stop to restrict movement of the pusher guide beyond the stop.

8. The food processing device of claim 6, further comprising a cap configured to be received by the pusher guide, the pusher guide having a central opening for receiving a portion of the cap.

9. The food processing device of claim 6, wherein the pusher guide further comprises a first cylinder having a central axis substantially orthogonal to the plane of the tray, the first cylinder further having an open interior portion to allow a food item to be inserted into the open interior; and the cap further comprises a second cylinder and an outer wall separated from the second cylinder and defining a channel between the second cylinder and the outer wall;

whereby when the cap is positioned on the pusher guide the second cylinder is received within the first cylinder and the first cylinder is received within the channel.

10. The food processing device of claim 9, wherein the first cylinder includes at least one post and the cap includes at least one stop, the at least one stop configured to interact with the at least one post to restrict rotational movement of the cap with respect to the pusher guide.

11. The food processing device of claim 10 wherein the at least one stop includes a first stop formed on the cap and a second stop formed on the cap, the first stop being diametrically opposite the second stop; and the at least one post includes a first pair of posts formed on the first cylinder and being spaced apart from one another sufficiently to allow the first stop to be slideably received between the first pair of posts, and a second pair of posts formed on the first cylinder and being spaced apart from one another sufficiently to allow the second stop to be slideably received between the second pair of posts when the first stop is received between the first pair of posts;

whereby the cap is selectively removably positioned on the pusher guide in a first position in which the first stop is received between the first pair of posts and the second stop is received between the second pair of posts in order to restrict rotational movement of the cap with respect to the pusher guide.

12. The food processing device of claim 11, wherein the first pair of posts and the second pair of posts are separated from one another and define a pair of opposing receiving surfaces whereby the cap may be optionally received by the pusher guide in a second position such that the first stop is received between one of the first pair of posts and one of the second pair of posts while the second stop is received between the other one of the first pair of posts and the other one of the second pair of posts.

13. The food processing device of claim 12, wherein first pair of posts and second pair of posts are separated from one another to allow for approximately 90 degrees of rotational movement of the cap with respect to the pusher guide when the cap is in the second position.

14. The food processing device of claim 13, wherein the cap further includes a lower surface, the lower surface being substantially adjacent the tray when the cap is received by the pusher guide, the cap further comprising a plurality of spikes extending outward from the lower surface.

* * * * *